United States Patent [19]

Riplinger

[11] Patent Number: 4,896,863

[45] Date of Patent: Jan. 30, 1990

[54] SYSTEM HAVING MATERIAL DISPENSING AND WIND UP DEVICE WITH GUIDE

[76] Inventor: Tim Riplinger, 35912 Helendale, Ingleside, Ill. 60041

[21] Appl. No.: 199,312

[22] Filed: May 26, 1988

[51] Int. Cl.[4] ..... G01M 19/00

[52] U.S. Cl. ..... 254/134.3 FT

[58] Field of Search ..... 242/68.7; 254/134.3 R, 254/134.3 FT

[56] References Cited

U.S. PATENT DOCUMENTS

| | | | |
|---|---|---|---|
| 215,609 | 5/1879 | Hanford . | |
| 447,153 | 2/1891 | Holmes . | |
| 545,549 | 9/1895 | Strodel et al. . | |
| 1,022,077 | 4/1912 | Haas . | |
| 1,664,467 | 4/1928 | Roeske . | |
| 2,488,492 | 11/1949 | Dumbleton . | |
| 2,515,724 | 7/1950 | McCroskey | 254/134.3 R |
| 2,601,960 | 7/1952 | Hick . | |
| 2,958,478 | 11/1960 | Petersen et al. | 242/68.7 |
| 3,028,117 | 4/1962 | Shepley . | |
| 3,069,107 | 12/1962 | Hirt . | |
| 3,190,574 | 6/1965 | Purzycki . | |
| 3,304,025 | 2/1967 | Zerg et al. . | |
| 3,346,214 | 10/1967 | Berkeley . | |
| 3,603,526 | 9/1971 | Payne . | |
| 3,937,418 | 2/1976 | Guenther . | |
| 4,143,832 | 3/1979 | Platt . | |
| 4,548,368 | 10/1985 | Tomlinson . | |
| 4,644,791 | 2/1987 | Sonoda et al. | 254/134.3 FT |

FOREIGN PATENT DOCUMENTS

| | | | |
|---|---|---|---|
| 617595 | 2/1927 | France | 242/68.7 |

*Primary Examiner*—Robert C. Watson

*Attorney, Agent, or Firm*—Hill, Van Santen, Steadman & Simpson

[57] ABSTRACT

A system for dispensing material into a conduit attached to a terminal box and for supporting at least one spool of material having first and second end sections, a material supply and wind up device. The material supply and wind up device has at least first and second end portions and at least three rollers secured between the first and second end portions. The three rollers releasably hold the first and second end sections of the spool, thereby dispensing wire or other material in any one of substantially 360°. The system further has a guide for guiding the wire through the terminal box and in the conduit. The guide is a substantially frictionless collar having an aperture through which the material slides. The aperture has a predetermined cross-sectional configuration. The material supply and wind up device releasably holds the spool of wire without the use of a shaft through the center of the spool. This provides for the spool to be removed or inserted into the material supply and wind up device without any disassembly of the device and without removing any other spools of wire contained by the device. This device may also be used to dispense or wind up material in sheet form.

32 Claims, 9 Drawing Sheets

SYSTEM HAVING MATERIAL DISPENSING AND WIND UP DEVICE WITH GUIDE

BACKGROUND OF THE INVENTION

The present invention relates in general to devices for holding, transporting, dispensing and winding material such as wire or sheet material and, in particular, to a system for dispensing electrical wire and pulling the wire through conduit.

The difficulties of pulling wire through conduit, such as during the construction of buildings are well known in the prior art. Typically, the wires must be lubricated or special insulation is provided on the wire which allows it to slide easily through an electrical junction box which is attached to an end of the conduit. Numerous devices for dispensing wire wound on spools are known in the prior art, but have the drawback that the spools are held on a common shaft and therefore, replacing one of the spools requires disassembly of the device and the removal of at least some of the spools. Electrical wire, as well as other coiled materials, also come packaged in cardboard containers in which the wire is withdrawn from the center of the container. A drawback in the prior art is that kinks can occur in the wire as it is withdrawn from the cardboard container which then prevent the wire from passing through conduit. In the case of the spools being on a common shaft, the wire can slip off the side of the spool and become wrapped around the shaft, thereby also preventing the pulling of the wire through the conduit.

Many other devices are known which provide for material in the form of such as sheet goods, such as plastic, to be dispensed from a spool as well as devices which provide for winding the sheet material onto a spool. Typically, these devices require that a shaft extend through the spool. This again requires that the device be at least partially dismantled when interchanging the spools.

The present invention overcomes these drawbacks in the prior art and provides for controlled payout or wind up of material on a spool, as well as easy interchangeability of the spools without disassembly of the device.

SUMMARY OF THE INVENTION

In one embodiment the present invention relates to a system for dispensing material into a conduit attached to a terminal box and for supporting at least one spool for holding material which has at least first and second end sections. The system has a material supply and wind up device having at least first and second end portions. At least three means for rolling are rotatably secured between the first and second end portions. The three means for rolling releasably hold the first and second end sections of the spool, thereby dispensing the material any one of substantially 360° of direction about the spool. The system further has a substantially frictionless collar having an aperture through which the material slides, the aperture having a predetermined cross-sectional configuration for guiding the material through the terminal box and in the conduit.

In one embodiment of the present invention, the collar is attached to a plate which is secured to the terminal box and in another embodiment of the present invention, the collar is connected directly to a termination connecting the conduit to the terminal box. The collar has an outside end and an inside end and at least the outside end has an outwardly tapering surface. The inside end may also have a similar outwardly tapering surface. As an alternative, the collar can have attached to its outside end a substantially ring-shaped ball bearing structure wherein the material passes over at least some of the ball bearings of the structure.

The material supply and wind up device can have three rollers displaced approximately 120° from neighboring rollers or in another embodiment, can have four rollers displaced approximately 90° from neighboring rollers. For inserting or removing a spool of wire or sheet material into the material supply and wind up device in one embodiment at least one of the rollers is pivotably attached to each of the first and second ends. Also, a pair of drive rollers can be used to contact the spool and provide a means for winding material onto the spool. Other variations of the present invention are described below.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures in which like reference numerals identify like elements, and in which:

DESCRIPTION OF THE PREFERRED EMBODIMENT

The present invention has general applicability and can be utilized in a vast variety of applications. For example, the system of the present invention can be utilized for pulling wire through conduit in new building construction. In another embodiment of the present invention, the material supply and wind up device can be utilized to pay out or wind up sheet material such as flexible plastic. In all of the numerous embodiments being described, the present invention provides that the spools of material can be easily inserted and removed from the device without any disassembly of the device and without the need to remove any of the other spools which may be contained in the device. It is a feature of the present invention that there is no shaft which extends through a core of the spools.

Figure 1:
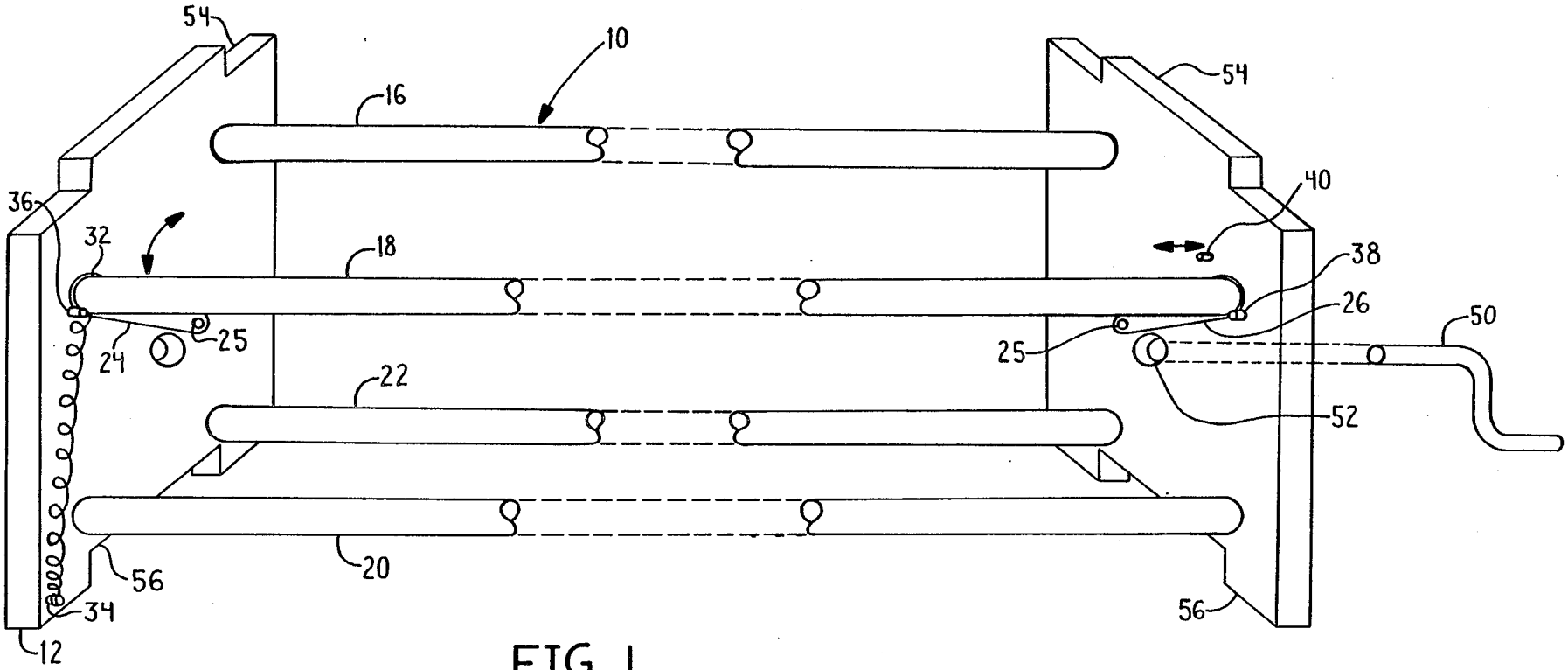
FIG. 1 a perspective view of the material supply and wind up device of the present invention.
Figure 4:
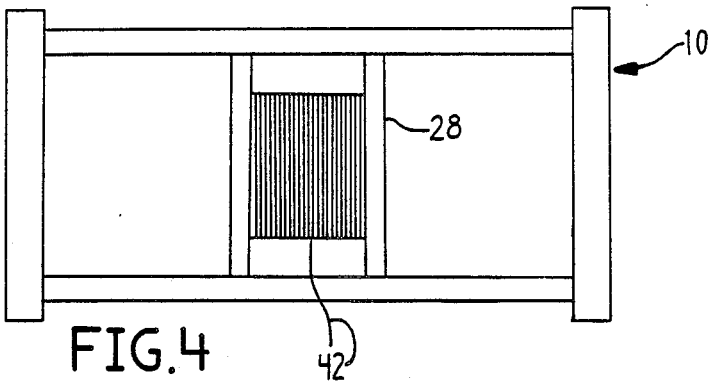
FIG. 4 is a side view of the FIG. 1 device showing a spool of wire inserted in the device.
Figure 5:
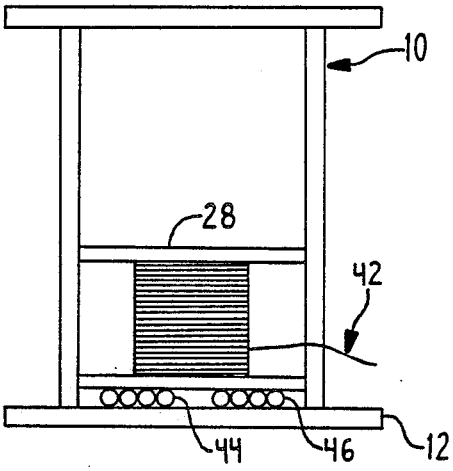
FIG. 5 is a side view of the FIG. 4 device rotated 90°.

FIG. 1 shows a first embodiment of the present invention. A material supply and wind up device 10 has first and second end portions 12 and 14. Four rollers 16, 18, 20 and 22 are rotatably secured between the first and second end portions 12 and 14. At least one of the rollers, such as roller 18, is connected by arms 24 and 26 to a location 25 on the end portions 12 and 14 such that the roller 18 may be pivoted towards the roller 16, for example, to allow the insertion of a means for holding material or spool 28 as can be seen in FIGS. 4 and 5. The roller 18 can be held in a "closed" position by a variety of means, one example being the spring 30 connected between the end 32 of the roller 18 and the location 34 on the first end portion 12. Numerous other mechanisms can be utilized for pivoting the roller !8 and retaining it in a "closed" position. As shown in FIG. 1, stops 36 and 38 determine the "closed" position. Furthermore, pin 40 which may be moved in the direction of the arrows as shown to provide a lock mechanism for the roller 18. As also shown in FIGS. 4 and 5, a wire 42 can be pulled off of the spooll 28 in any of substantially 360° about the material supply and wind up device 10. The material supply and wind up device 10 is shown in a horizontal position in FIG. 4, but can also be utilized in a vertical position as shown in FIG. 5 wherein bearing supports 44 and 46 are mounted on the first end portion 12 to allow rotation of the spool 28.

In order to wind wire onto a spool, a crank 50 can be provided which is inserted through aperture 52 to engage a core of the spool. Various other mechanical devices which may be motorized can be utilized which have shafts which extend thorough the aperture 52. A top section 54 of the first end portion 12 can have a predetermined configuration which matches a bottom portion 56. A similar structure is also provided on the second end portion 14. This allows a plurality of material supply and wind up devices to be stacked on top of one another or as an alternative, a substantially flat top portion (not shown) can also be secured to the top ends 54.

Figure 2:
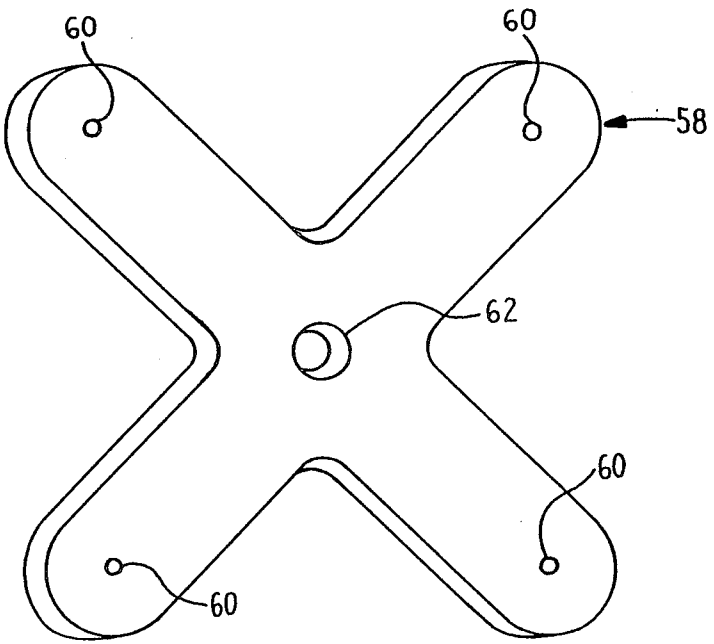
FIG. 2 is a perspective view of an alternative end portion of the 1 device.

FIG. 2 shows an alternative configuration for each of the first and second end portions of the material supply and wind up device. This end portion 58 shown in FIG. 2 is substantially "x"-shaped and has locations 60 for securing the rollers 18, 16 20 and 22 to the end portion 58. An aperture 62 can also be provided in substantially the center of the end portion 58 for insertion of a means of rotating the spool for winding up material.

Figure 3:
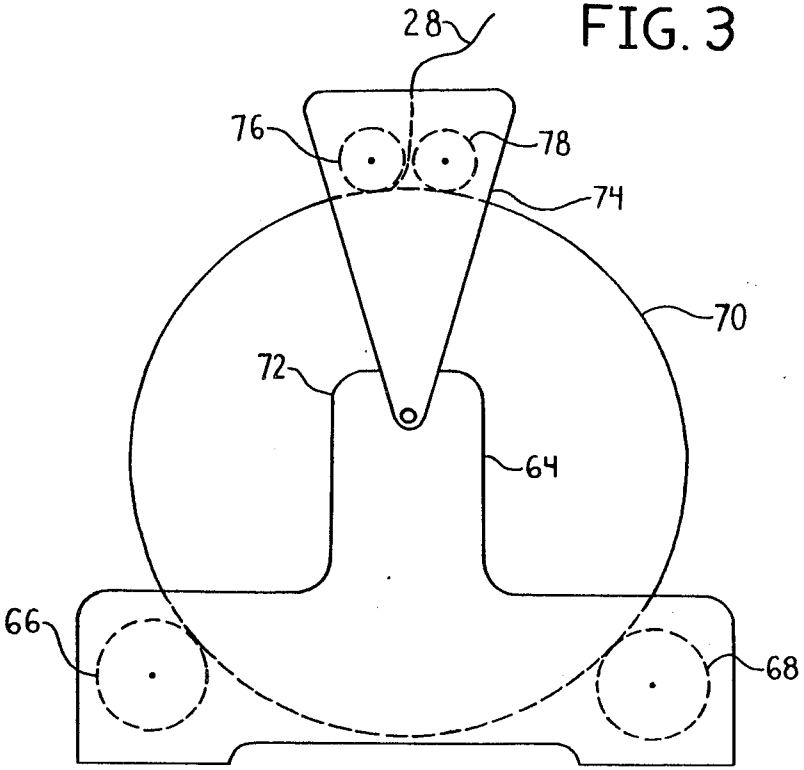
FIG. 3 is an end view of another alternative embodiment of the present invention.

FIG. 3 shows another alternative embodiment of the present invention in which a base 64 has attached thereto first and second rollers 66 and 68 on which the spool 70 rests. An end 72 of the base 64 has pivotably attached to it an arm 74 having third and fourth rollers 76 and 78. In this embodiment, the wire 28 is paid off of the spool 70 between the third and fourth rollers 76 and 78. A wire 28 may be paid out in a large angular direction due to the fact that the arm 74 can rotate about the end 72 of the base 64.

Figure 6:
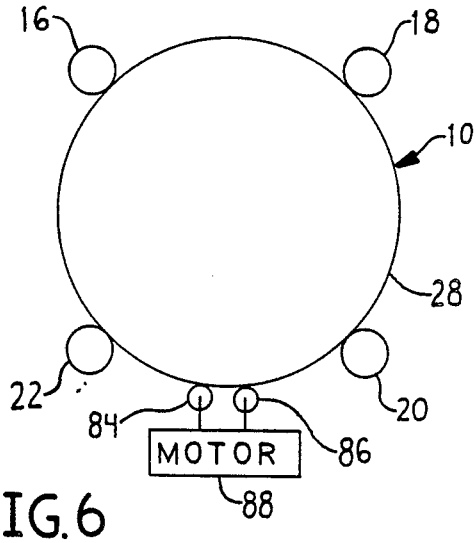
FIG. 6 is an end view depicting the use of four rollers and two drive rollers in the material supply and wind up device.
Figure 7:
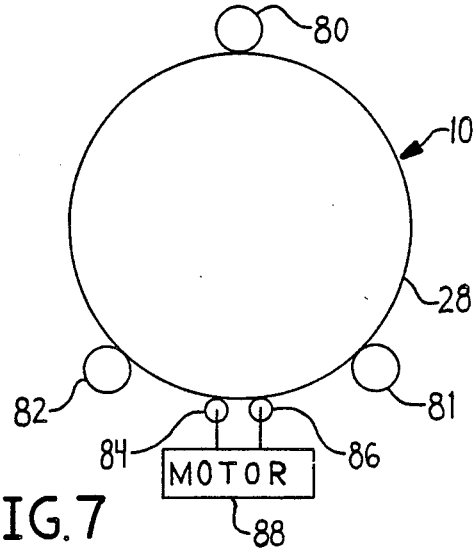
FIG. 7 is an end view depicting three rollers and two drive rollers used in the material supply and take up device.

As shown schematically in FIGS. 6 and 7, the material supply and wind up device 10 can utilize either four rollers 16, 18, 20 and 22, as shown in FIG. 6, or three rollers such as rollers 80, 81 and 82, as shown in FIG. 7. In the FIG. 7 embodiment, the three rollers 80, 81 and 82 can be substantially 120° apart Obviously, for certain applications, additional rollers could be utilized. Furthermore, drive rollers such as drive rollers 84 and 86 shown in FIGS. 6 and 7 can be used for rotating the spool 28 thereby providing the means for winding wire or other materials onto the spool 28. The drive rollers 84 and 86 may be powered by any conventional means by a motor 88. It can also be envisioned that in some applications, only one drive roller need be utilized.

Figure 8:
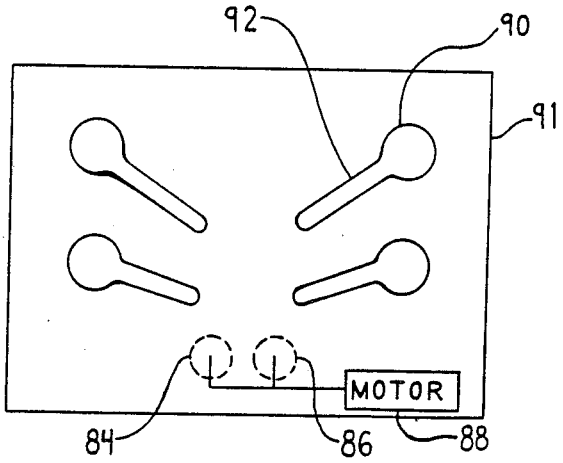
FIG. 8 is an end view of an alternative end portion for use in the material supply and take up device.
Figure 9:
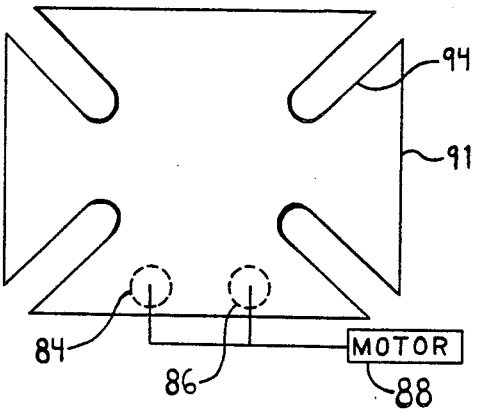
FIG. 9 is an end view of another alternative end portion for use in the material take up and supply device.
Figure 10:
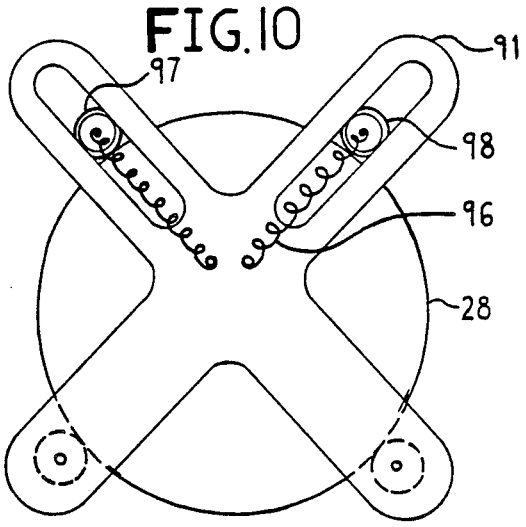
FIG. 10 is an end view of the material supply and take up device having adjustable rollers.

FIGS. 8 and 9 are end views of alternative embodiments of the first and second end portions of the material supply and wind up device 10. These embodiments of an end portion 91 allow the rollers to be removable from the material supply and wind up device. For example, in the embodiment of FIG. 8, the roller may be inserted through the aperture 90 with its axis or other means retaining the roller in the associated slot 92. Alternatively, the rollers could be inserted into slots 94, such as shown in FIG. 9, each of which has an opening in the end portion 91. Also shown in FIG. 8 and FIG. 9 are the drive rollers 84 and 86 powered by the motor 88. Each of the slots shown in the end portions 91 of FIGS. 8 and 9, as well as the slots which do not allow removal of the rollers such as shown in FIG. 10, can be provided in end portions 91 which have means, such as springs 96, which retain the rollers against the spool 28 or in the case of material wound on a core against the material itself, it is to be understood that in this instance the material itself is considered to be the spool 2B. Further it can be see that in the embodiment of FIG. 10 two rollers 97 and 98 can be adjustable with the other two rollers being stationary. It can be appreciated by one skilled in the art that various combinations of the features set forth in the FIGS. 1–10 can be utilized to construct various embodiments of the present invention.

Figure 11:
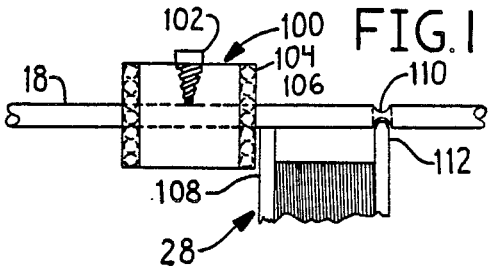
FIG. 11 is a side view of a spacer for use on the rollers of the FIG. 1 device.
Figure 12:
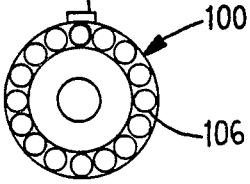
FIG. 12 is an end view of the FIG. 11 spacer.

FIG. 11 and FIG. 12 show a retainer 100 which is slidably located on one of the rollers such as roller 18. The retainer 100 can be locked to the roller 18 by a screw 102 or any other appropriate means. The retainer 100 has ends such as end 104 which has exposed ball bearings 106 against which an end face 108 of the spool 28 rides in a frictionless fashion. The use of retainers 100 allows the spool 28 to be positioned within the material supply and wind up device 10.

As also shown in FIG. 11 an alternative spacing means can be a notch 110 in the roller 18 in which an edge 112 of the spool 28 rides. Obviously, the use of notches 110 in the roller 18 precludes any axial adjustment of the location of the spool 28 in the material supply and wind up device 10.

Figure 14:
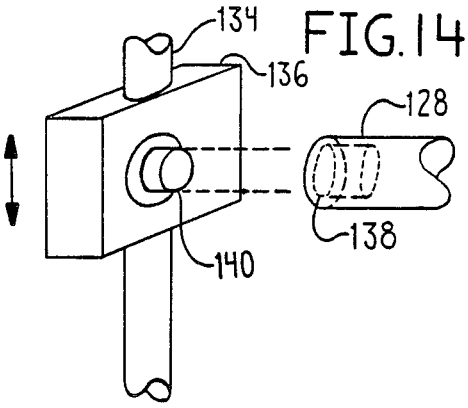
FIG. 14 is a perspective view of a core chuck used with the FIG. 13 device.
Figure 13:
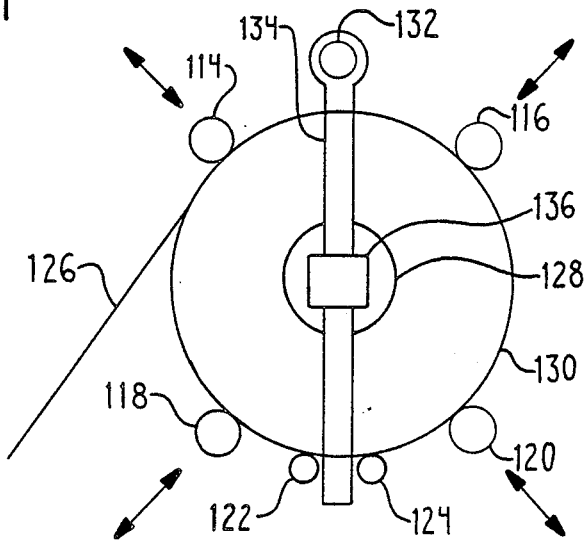
FIG. 13 is an end view of an alternative embodiment of the material supply and take up device having adjustable rollers.

An end view of yet another alternative embodiment is depicted in FIG. 13. This embodiment is especially useful for winding material, such as plastic sheeting, onto a core 128. The material supply and wind up device in the illustrated embodiment has four rollers 114, 116, 118 and 120 which are adjustable in a substantially radial direction as indicated by the arrows. The mechanism for adjusting the rollers 114, 116, 118 and 120 may be any of those set forth above. In addition, this embodiment utilizes two drive rollers 122 and 124 which contact the material 116 which is being wound onto the core 128. The drive rollers 122 and 124 cause the material 130 already wound onto the core 128 to rotate thereby winding more material 126. A fifth stationary bar 132 is connected between the first and second end portions of the material supply and wind up device. At least two bearing bars 134, on either side of the material 130 are connected in a slideable fashion to the stationary support bar 132 and extend substantially perpendicular to the support bar 132 and extend between the drive rollers 122 and 124. At least two core chucks 136 are slideably attached to the bearing bars 134 and engage hollow areas 136 in the core 128. The core chuck 136 has means 140 rotatable within the core chuck 136 for engaging the hollow 138 in the core 128 (see FIGS. 13 and 14).

Figure 15:
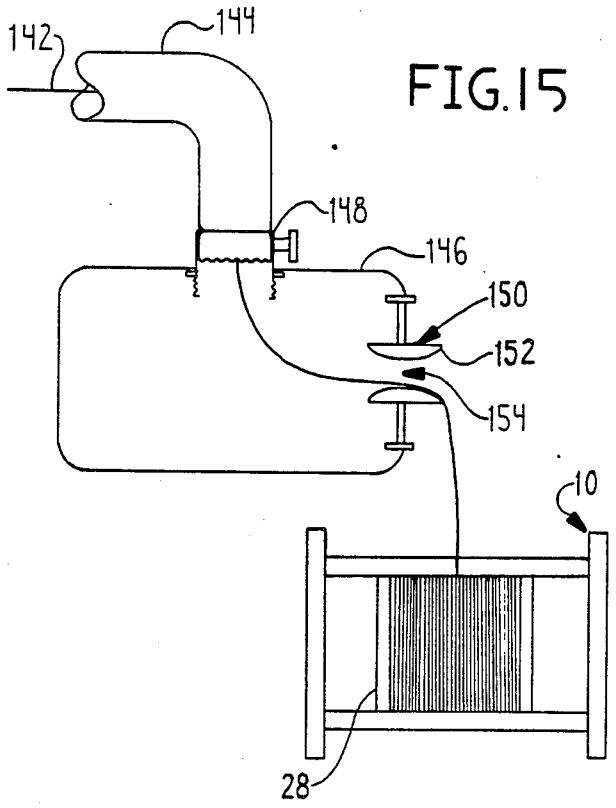
FIG. 15 is a schematic representation of the material supply and take up device used with a guide for pulling wire through conduit.

The present invention is especially applicable to a system for pulling wire through conduit as shown in FIG. 15. A wire 142 is pulled through conduit 144, as is typically done in new construction. The conduit 144 is attached to an electrical terminal box 146 by a connector 148. A guide 150 is attached to the terminal box 146 and forms part of the novel system of the present invention. The guide 150 has a substantially frictionless collar 152 which has an aperture 154 through which the wire slides The aperture 154 has a predetermined cross-sectional configuration for guiding the wire 142 through the terminal box 146 and the conduit 144. The wire 142 is supplied from a spool 28 of wire in a material supply and wind up device 10 constructed as described above in any one of the many embodiments. Another guide can also be used on a terminal box connected to the conduit and through which the wire exits. FIGS. 16 through 23 show alternative embodiments of the guide 150.

Figure 16:
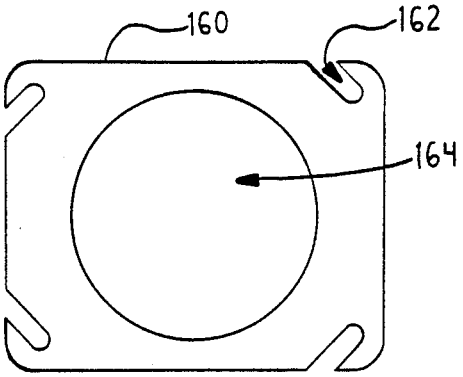
FIG. 16 is a plan view of a embodiment of the guide used in the system.
Figure 17:
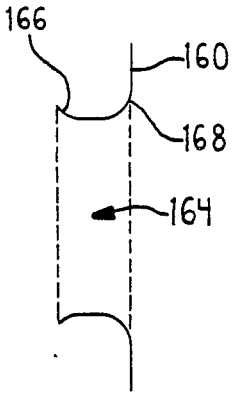
FIG. 17 is a cross-sectional view of the FIG. 16 guide.
Figure 18:
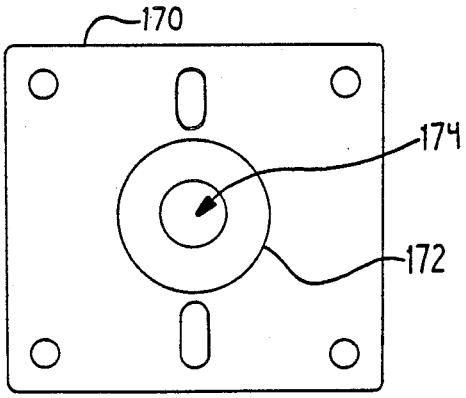
FIG. 18 is a plan view of an alternative embodiment of the guide.
Figure 19:
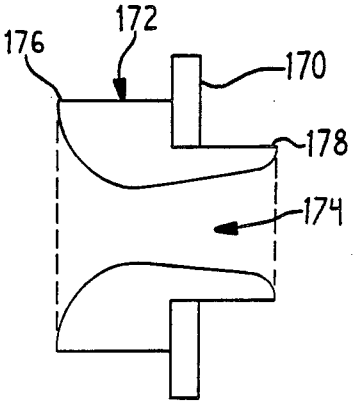
FIG. 19 is a cross-sectional view of the FIG. 18 guide.
Figure 20:
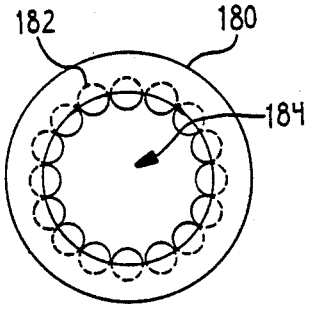
FIG. 20 is an alternative embodiment of the guide.
Figure 21:
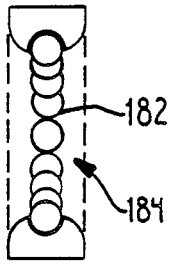
FIG. 21 is a cross-sectional view of the FIG. 20 guide.

As shown in FIG. 16, the guide may be a plate 160 which attaches by means of slots 162 to the terminal box 146 with screws which are typically supplied with the terminal box 146. Aperture 164 in the plate 160 has an inside end 166 and an outside end 168 each of which has an outwardly tapering surface as particularly shown in the cross-sectional view of FIG. 17. In the embodiment of FIG. 18, a plate 170 is provided for attachment to the terminal box 146 and contains a collar 172 which may be made of a frictionless material such as Teflon (registered trademark). The collar 172 has an aperture 174. As shown in FIG. 19 in a cross-sectional view, the collar 172 has an inside end 176 and an outside end 178, each of which has an outwardly tapering surface. In a further alternative embodiment, as shown in FIG. 20, the collar may be a ball bearing structure 180 which has a circular configuration of ball bearings 182. As shown in the cross-sectional view of FIG. 21, the ball bearings 182 are exposed so that the wire 142 will ride over the surface of some of the ball bearings 182 when it is pulled through the aperture of 184.

Figure 22:
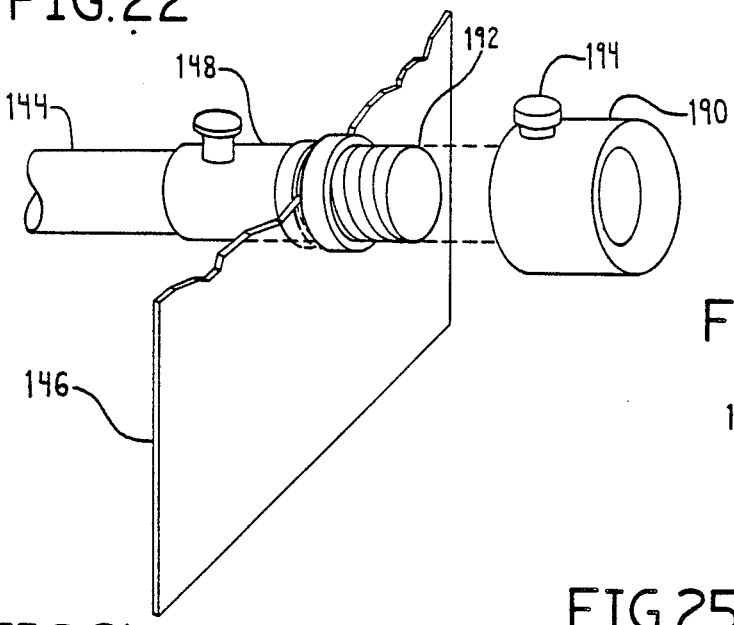
FIG. 22 is a partially cut-away perspective view of an alternative embodiment of the guide attached to a terminal connecting the conduit to an electrical terminal box.
Figure 23:
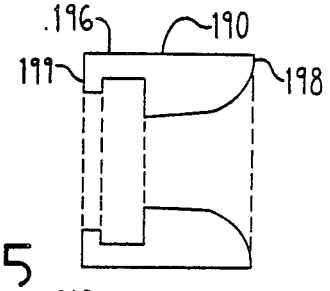
FIG. 23 is a cross-sectional view of the FIG. 22 guide.

In yet another alternative embodiment of the guide as shown in FIGS. 22 and 23, the guide may be a collar 190 which fits directly over an end 192 of the connector 148 which connects the conduit 144 to the terminal box 146. A screw 194 may be used on the collar 190 to secure the collar 190 to the end 192 of the connector 148. As can be particularly seen in FIG. 23 in a cross-sectional view the collar 190 has an inside end 196 and an outside end 198. In this embodiment the outside end 198 has an outwardly tapering surface and the inside end 196 has a lip 199 which secures the collar 190 to the end 192 of the connector 148. Again, the connector 190 is made of a substantially frictionless material such as Teflon.

Figure 26:
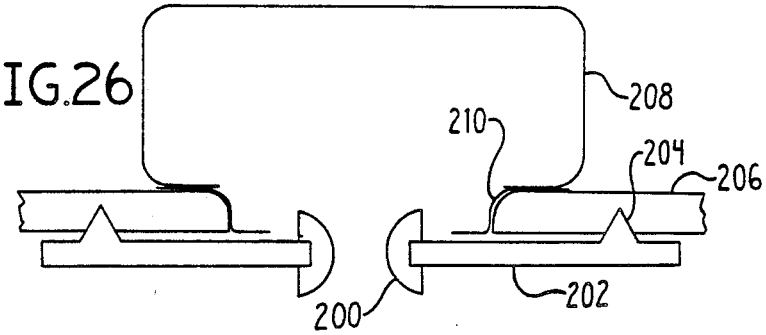
FIG. 26 is a cross-sectional view of an alternative embodiment of a guide.

FIG. 26 shows another alternative embodiment of a collar 200 attached to a plate 202. In this embodiment, the plate 202 has nail-like extensions 204 which can be embedded in wall board type material 206 so as to hold the plate 202 in position. The plate 202 and the collar 200 is positioned over an opening of a terminal box 208 which has a flange 210 connected to a front of the terminal box 208 as is well known in dry wall construction. This alternative embodiment of the present invention is particularly applicable to new construction wherein the wall board material 206 has already been installed before any wires have been pulled through the terminal box 208 and conduit connected thereto.

Figure 24:
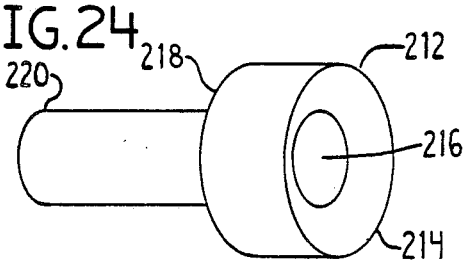
FIG. 24 is a perspective view of an alternative embodiment of a guide.
Figure 25:
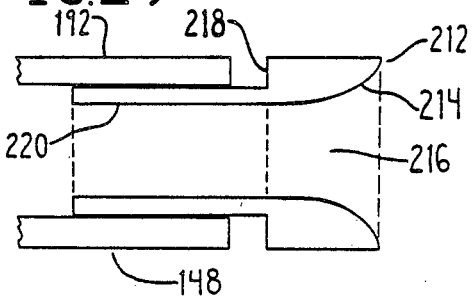
FIG. 25 is a cross-sectional view of the FIG. 24 guide.

FIGS. 24 and 25 show a further embodiment of a collar constructed according to the present invention. As shown, the collar 212 has an outer end 214 with an aperture 216. The outer end 214 has an outwardly sloping configuration. An inner end 218 of the collar 212 has attached thereto a substantially tubular section 220. The tubular section 220 slips inside of the end 192 of the connector 148.

Figure 27:
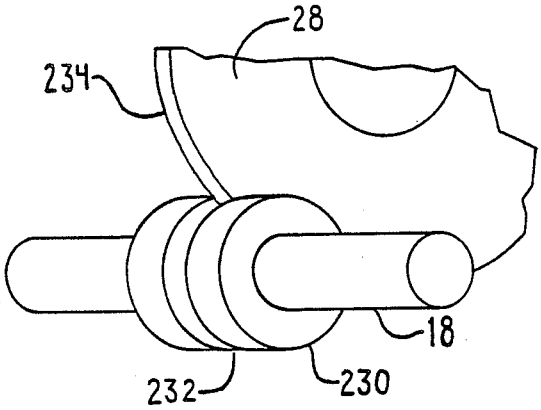
FIG. 27 is a partially cut-away perspective view of an alternative embodiment of a portion of the material supply and take up device.

Another alternative embodiment of the material supply and wind up device is shown in FIG. 27, wherein a ring bearing 230 is attached in a freely moveable manner to one of the rollers, such as roller 18. The bearing 230 has a notch 232 in which an edge 234 of the spool 28 rides. In this embodiment, the bearing 230 is allowed to freely turn thus, providing an embodiment in which the roller 18 may be fixed. As can be envisioned means for keeping the bearing 230 in a fixed location on the roller 18 can be provided.

Figure 28:
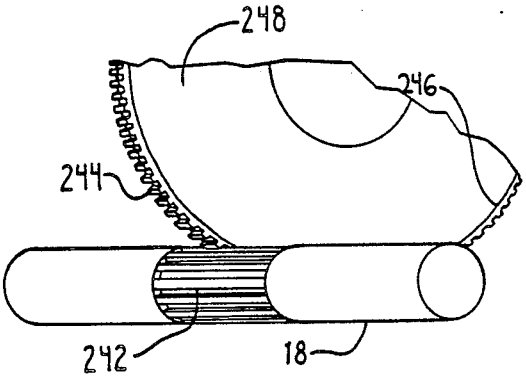
FIG. 28 is a partially cut-away perspective view of an alternative embodiment of a portion of the material supply and take up device.

In the embodiment shown in FIG. 28 the roller 18 has a portion 240 which has a first set of gear teeth 242. A second set of gear teeth 244 is provided on an edge 246 of a spool 248 and meshes with the first set of gear teeth 242 on the roller 18. As can be appreciated, the roller 18 can thereby be driven to rotate the spool 248 for winding material onto the spool 248. Alternatively, the drive rollers, such as drive rollers 84 and 86, in FIGS. 6 and 7, it can have portions with the gear teeth for engaging the gear teeth on the spool 28. For certain applications all rollers can have gear teeth.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. A system for dispensing material into a conduit attached to a terminal box for supporting at least one means for holding material having at least first and second end sections comprising:

at least one material supply and wind up device having at least first and second end portions and at least three means for rolling rotatably secured between said first and second end portions, said three means for rolling releasably holding said first and second end sections of said means for holding, thereby dispensing said material in at least one of substantially 360°;

at least one substantially frictionless collar having an aperture through which the material slides, said aperture having a predetermined cross-sectional configuration for guiding said material through said terminal box and in said conduit; and at least one of said means for rolling having at least a pair of lockable means for spacing slideable on said one of said means for rolling for retaining said means for holding in a predetermined axial position.

2. The system for dispensing material into a conduit attached to a terminal box according to claim 1, wherein said system further comprises means for attaching said collar to said terminal box.

3. The system for dispensing material into a conduit attached to a terminal box according to claim 1, wherein said collar has an outside end and an inside end and wherein at least said outside end has an outwardly tapering surface.

4. The system for dispensing material into a conduit attached to a terminal box according to claim 3, wherein said inside end of said collar also has an outwardly tapering surface.

5. The system for dispensing material into a conduit attached to a terminal box according to claim 1, wherein said aperture of said collar is substantially circular.

6. The material supply and wind up device for supporting at least one means for holding material having at least first and second end sections in the system according to claim 1, wherein said device has at least four means for rolling.

7. The material supply and wind up device for supporting at least one means for holding material having at least first and second end sections in the system according to claim 1, wherein each of said four means for rolling are displaced approximately 90° from neighboring means for rolling.

8. The material supply and wind up device for supporting at least one means for holding material having at least first and second end sections in the system according to claim 1, wherein at least one of said means for rolling is pivotably at(ached to each of said first and second ends to allow insertion and removal of said means for holding.

9. The material supply and wind up device for supporting at least one means for holding material having at least first and second end sections in the system according to claim 1, wherein the material interfaces with said device from any of approximately 360° about said device.

10. The material supply and wind up device for supporting at least one means for holding material having at least first and second end sections in the system according to claim 1, wherein at least one of said first and second ends has an aperture located at approximately an axial center of at least one of said first and second ends and wherein said device further comprises a means for rotating said means for holding, said means for rotating engaging said means for holding and extending through said aperture in said one of said first and second ends.

11. A system for dispensing material into a conduit attached to a terminal box for supporting at least one means for holding material having at least first and second end sections comprising:

at least one material supply and wind up device having at least first and second end portions and at least three means for rolling rotatably secured between said first and second end portions, said three means for rolling releasably holding said first and second end sections of said means for holding, thereby dispensing said material in at least one of substantially 360°;

at least one substantially frictionless collar having an aperture through which the material slides, said aperture having a predetermined cross-sectional configuration for guiding said material through said terminal box and in said conduit; and at least one of said means for rolling having a pair of notches for engaging edges of said first and second end sections of said means for holding thereby retaining said means for holding in a predetermined axial position.

12. The system for dispensing material into a conduit attached to a terminal box according to claim 11, wherein said system further comprises means for attaching said collar to said terminal box.

13. The system for dispensing material into a conduit attached to a terminal box according to claim 1, wherein said collar has an outside end and an inside end and wherein at least said outside end has an outwardly tapering surface.

14. The system for dispensing material into a conduit attached to a terminal box according to claim 1, wherein said inside end of said collar also has an outwardly tapering surface.

15. The system for dispensing material into a conduit attached to a terminal box according to claim 1, wherein said aperture of said collar is substantially circular.

16. The material supply and wind up device for supporting at least one means for holding material having at least first and second end sections in the system according to claim 1, wherein said device has at least four means for rolling.

17. The material supply and wind up device for supporting at least one means for holding material having at least first and second end sections in the system according to claim 16, wherein each of said four means for rolling are displaced approximately 90° from neighboring means for rolling.

18. The material supply and wind up device for supporting at least one means for holding material having at least first and second end sections in the system according to claim 1, wherein at least one of said means for rolling is pivotably attached to each of said first and second ends to allow insertion and removal of said means for holding.

19. The material supply and wind up device for supporting at least one means for holding material having at least first and second end sections in the system according to claim 1, wherein the material interfaces with said device from any of approximately 360° about said device.

20. The material supply and wind up device for supporting at least one means for holding material having at least first and second end sections in the system according to claim 1, wherein at least one of said first and second ends has an aperture located at approximately an axial center of at least one of said first and second ends and wherein said device further comprises a means for rotating said means for holding, said means for rotating engaging said means for holding and extending through said aperture in said one of said first and second ends.

21. A material supply and wind up device for supporting at least one means for holding material having at least first and second end sections comprising:

at least first and second portions;

at least three means for rolling rotatably secured between said first and second end portions, said three means for rolling releasably holding said first and second end sections of said means for holding; and at least one of said means for rolling having at least one pair of notches for engaging edges of said first and second end sections of said means for holding thereby retaining said means for holding in a predetermined axial position.

22. The material supply and wind up device for supporting at least one means for holding material having at least first and second end sections according to claim 21, wherein said device has at least four means for rolling.

23. The material supply and wind up device for supporting at least one means for holding material having at least first and second end sections according to claim 22, wherein each of said four means for rolling are displaced approximately 90° for neighboring means for rolling.

24. The material supply and wind up device for supporting at least one means for holding material having at least first and second end sections according to claim 21, wherein at least one of said means for rolling is pivotably attached to each of said first and second ends to allow insertion and removal of said means for holding.

25. The material supply and wind up device for supporting at least one means for holding material having at least first and second end sections according to claim 21, wherein the material interfaces with said device from at least one of approximately 360° about said device.

26. The material supply and wind up device for supporting at least one means for holding material having at least first and second end sections according to claim 21, wherein at least one of said first and second ends has an aperture located at approximately an axial center of at least one of said first and second ends and wherein said device further comprises a means for rotating said means for holding, said means for rotating engaging said means for holding and extending through said aperture in said one of said first and second ends.

27. A material supply and wind up device for supporting at least one means for holding material having at least first and second end sections comprising:

at least first and second portions;

at least three means for rolling rotatably secured between said first and second end portions, said three means for rolling releasably holding said first and second end sections of said means for holding; and at least one of said means for rolling having at least a pair of lockable means for spacing slideable on at least one of said means for rolling for retaining said means for holding in a predetermined axial position.

28. The material supply and wind up device for supporting at least one means for holding material having at least first and second end sections according to claim 27, wherein said device has at least four means for rolling.

29. The material supply and wind up device for supporting at least one means for holding material having at least first and second end sections according to claim 28, wherein each of said four means for rolling are displaced approximately 90° from neighboring means for rolling.

30. The material supply and wind up device for supporting at least one means for holding material having at least first and second end sections according to claim 27, wherein at least one of said means for rolling is pivotably attached to each of said first and second ends to allow insertion and removal of said means for holding.

31. The material supply and wind up device for supporting at least one means for holding material having at least first and second end sections according to claim 27, wherein the material interfaces with said device from at least one of approximately 360° about said device.

32. The material supply and wind up device for supporting at least one means for holding material having at least first and second end sections according to claim 27, wherein at least one of said first and second ends has an aperture located at approximately an axial center of at least one of said first and second ends and wherein said device further comprises a means for rotating said means for holding, said means for rotating engaging said means for holding and extending through said aperture in said one of said first and second ends.

* * * * *